US007836741B2

(12) United States Patent
Johnston

(10) Patent No.: US 7,836,741 B2
(45) Date of Patent: Nov. 23, 2010

(54) ROTARY EXPANSION

(75) Inventor: Gary Johnston, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 403 days.

(21) Appl. No.: 11/549,500

(22) Filed: Oct. 13, 2006

(65) Prior Publication Data

US 2007/0084599 A1 Apr. 19, 2007

(30) Foreign Application Priority Data

Oct. 14, 2005 (GB) ..... 0520859.0

(51) Int. Cl.
*B21D 3/02* (2006.01)
*B21D 37/00* (2006.01)
*B21B 45/02* (2006.01)

(52) U.S. Cl. ..... 72/117; 122/43; 122/482.5

(58) Field of Classification Search ..... 72/117, 72/122–123, 43, 482.5
See application file for complete search history.

(56) References Cited

U.S. PATENT DOCUMENTS 5,014,779 A 5/1991 Meling et al.
6,416,224 B1 * 7/2002 Nixon et al. ..... 384/93
6,722,441 B2 4/2004 Lauritzen et al.
2002/0166664 A1 * 11/2002 Lauritzen et al. ..... 166/277
2003/0075337 A1 4/2003 Maguire
2003/0140673 A1 * 7/2003 Marr et al. ..... 72/58
2003/0190102 A1 * 10/2003 Horng et al. ..... 384/292
2005/0005668 A1 1/2005 Duggan et al.
2005/0007259 A1 1/2005 Minto et al.
2005/0072569 A1 4/2005 Johnston et al.
2007/0215360 A1 * 9/2007 Shuster et al. ..... 166/380

FOREIGN PATENT DOCUMENTS

GB 2406868 4/2005
WO WO 00/37766 6/2000
WO WO 03/055616 7/2003
WO WO 2005/079186 * 9/2005

OTHER PUBLICATIONS

Great Britain Search Report for patent application serial no. GB0520859.0, dated Nov. 22, 2005.

* cited by examiner

*Primary Examiner*—Dana Ross
*Assistant Examiner*—Mohammad Yusuf
(74) *Attorney, Agent, or Firm*—Patterson & Sheridan, L.L.P.

(57) ABSTRACT

An expansion member for a rotary expansion tool comprises a spindle adapted to be supported at both ends, and a roller mounted concentrically on the spindle. A sealed lubrication system is contained within the spindle for supplying lubricant to a bearing or bearing surface at an interface between the spindle and the roller.

29 Claims, 3 Drawing Sheets

ROTARY EXPANSION

CROSS-REFERENCE TO RELATED APPLICATIONS

This application claims benefit of Great Britain patent application serial number 0520859.0, filed Oct. 14, 2005, which is herein incorporated by reference.

BACKGROUND OF THE INVENTION

1. Field of the Invention

The present invention relates to rotary expansion tools for expanding tubing. In particular, but not exclusively, the present invention relates to an improved expansion member for a rotary expansion tool.

2. Description of the Related Art

A number of different tools have been proposed for carrying out expansion of downhole tubing such as expandable bore-lining tubing and expandable sand screens. Applicant's International Patent Application Publication No WO 2000/37766, the disclosure of which is incorporated herein by reference in its entirety, discloses a rotary expansion tool including a number of expansion members in the form of rollers mounted on radially moveable pistons. Fluid pressure urges the pistons radially outwardly to bring the rollers into contact with the tubing to be expanded. The tool is then rotated and advanced axially through the tubing to expand the tubing to a greater internal diameter.

The rollers are compliant such that if the tool encounters a portion of tubing which cannot be expanded, the rollers can move inwardly to advance through the restriction.

Failure of conventional compliant rotary expansion tools can be accelerated by exposure of tool bearing surfaces to well materials such as drilling fluid, mud, debris and solids. Furthermore, the use of an unlubricated bearing system restricts the combination of bearing pressure and velocity which can be withstood without degradation and thermal damage.

Applicant's WO 2003/055616, the disclosure of which is incorporated herein by reference in its entirety, discloses a rotary expansion tool in which a bearing area between an expansion roller and a supporting spindle is supplied with lubrication from a sealed lubrication system.

SUMMARY OF THE INVENTION

According to a first aspect of the present invention there is provided an expansion member for a rotary expansion tool, the expansion member comprising:

a spindle adapted to be supported at both ends;

a roller mounted concentrically on the spindle; and a sealed lubrication system contained within the spindle for supplying lubricant to at least a portion of at least one bearing or bearing surface located at an interface between the spindle and the roller.

Providing a self-contained sealed lubrication system within the spindle facilitates provision of a compact expansion member which has its primary bearing surface lubricated and isolated from well materials. This has the effect of reducing failure and extending the life cycle of the expansion member.

The at least one bearing may be at least one radial bearing. Alternatively, or in addition, the at least one bearing may be at least one journal bearing, roller bearing, thrust bearing or a combination thereof.

Preferably, the bearing is axially contained at both ends by faces formed by at least one of the spindle and the roller, which faces engage axial faces of the bearing.

Preferably, faces of the spindle or roller define a bearing contact area of substantially the same extent as, or greater area than, the axial faces of the bearing. This arrangement thus serves to minimise or prevent axial extrusion of the bearing.

Shoulders on the spindle or roller may provide the bearing contact areas.

The sealed lubrication system may comprise a lubricant reservoir in fluid communication with the at least one bearing, which lubricant reservoir may be defined by the spindle. The lubrication system may be arranged to urge lubricant from the reservoir towards said bearing or bearing surface. This arrangement facilitates continued lubrication of the tool in the event of loss or leakage of lubricant. This may be achieved by providing a variable volume reservoir with a wall or walls of the reservoir adapted to be urged to reduce the volume of the reservoir, for example a wall of the reservoir may be spring-biased to urge lubricant from the reservoir. The reservoir may comprise a cylindrical volume within the spindle. One end of the volume may comprise a piston member adapted to move along the axis of the volume. In one embodiment the axes of the volume and the cylinder are parallel, and may be coaxial, while in another embodiment the axes are mutually perpendicular or inclined.

The lubrication system may comprise one or more lubricant supply channels, which may also serve as lubrication reservoirs. The spindle may be provided with at least one axial lubricant supply channel, which may extend along the spindle axis. Further lubricant channels may provide fluid communication between an axial lubricant channel and the spindle\roller interface. Most preferably, these further lubricant channels extend substantially radially from the axial lubricant channel.

Bearing surfaces of at least one of the spindle, bearing and roller may define surface channels to facilitate movement or supply of lubricant to the surfaces. A surface of the bearing may define surface grooves or channels, and in a preferred embodiment a bearing sleeve features a helical surface groove.

Preferably, the interface between the spindle and the roller is sealed, typically by at least one O-ring seal, although other seal forms may be employed.

Pressure balance or equalisation may be maintained between the bearing lubrication system and external or ambient pressure by a valve which permits communication of external pressure, for example annulus or bore pressure, to the lubricant. The valve may be a poppet valve. Alternatively, pressure is communicated to the system by means of a diaphragm or floating piston. Accordingly, there is little or no pressure differential across the lubricant-retaining seals. In other embodiments it may be preferred to maintain the lubricant at a positive pressure, higher than external pressure, to minimise ingress of external material.

The expansion member may be utilised in an expansion tool having a fixed expansion diameter, or the expansion tool may be compliant. In a complaint tool, one or more expansion members may be extendable or retractable independently of the other expansion members. The expansion members may describe a fixed diameter, or may be movable between extended and retracted configurations, and in some cases the tool may be capable of operating at any one of a variety of expansion diameters. The expansion members may be adapted to move laterally of the tool axis.

Preferably, the spindle is mounted on a carrier, which may be in the form of a piston for mounting in a tool body. Alternatively, the spindle may be mounted directly to the tool body. A tool body may be provided in combination with the member and carrier, typically carriers being provided in one or more sets of three in a body. Preferably, the carriers are arranged to be radially movable relative to the body, and may be located in openings in the wall of the body. The carriers may be adapted to be laterally moveable relative to the body. In a retracted configuration the carriers may engage one another. Preferably, the engagement is such to provide for fluid passage through the body. The radial extension of the carriers relative to the body may be restricted, and in one embodiment this is achieved by a sleeve adapted for location over the body. Preferably, the sleeve defines windows through which the rollers may extend.

Preferably, the tool body and the carriers co-operate such that each spindle axis is inclined to the body axis, most preferably the spindle axes converging towards the leading end of the tool body.

Preferably, also, each roller defines a frusto-conical surface, such that the diameter described by the roller decreases towards a leading end of the body. Most preferably, each roller defines a trailing surface which describes a substantially constant diameter. Where the spindle axes are inclined to the body axis, the trailing surface of each roller may be frusto-conical.

The carrier may be configured such that the rollers are skewed relative to a plane intersecting and parallel to the body axis and intersecting the spindle axis.

According to a further aspect of the present invention there is provided a rotary expansion tool comprising:

a body;

at least one expansion member movable between a retracted configuration and an expanded configuration, the expansion member comprising a spindle; a roller mounted on the spindle; and a sealed lubrication system contained within the spindle for supplying lubricant to at least a portion of at least one bearing or bearing surface located at an interface between the spindle and the roller.

According to a still further aspect of the present invention there is provided an expansion member for a rotary expansion tool, the expansion member comprising:

a carrier adapted for mounting on an expansion tool body;

a spindle having a first end and a second end, the spindle ends being retained and supported by the carrier; and a roller mounted on the spindle.

At least one end of the spindle may be keyed to a face of the carrier. In other aspects of the invention the spindle may be coupled to the carrier by other means, such as fasteners.

An inner or distal end of the spindle may be received by a corresponding recess or bore in the carrier, thus restraining the roller against radial movement relative to the carrier. Furthermore, one or both of the spindle and bore may be stepped, or the bore may be blind to axially restrain the spindle.

An outer or proximal portion of the spindle and the carrier may define corresponding profiles, for example dovetail profiles, to provide for radial restraint of the spindle relative to the carrier. This contrasts with arrangements in which both ends of the spindle are received in bores in the carrier. Particularly when inclined axis rollers are utilised, the necessity to provide a bore to receive the radially outermost end of the spindle, and through which the rest of the spindle must pass, places restrictions on the spindle, carrier and roller form. Where the outer end of the spindle is fixed to the carrier by other means, preferably by providing a spindle with an outer integral profiled portion which cooperates with a corresponding profile on the carrier, the portion of the spindle within the roller may include relatively large diameter bearing portions. This offers numerous advantages, including a spindle of greater strength and rigidity, provision of a larger bearing area, and provision of relatively large area thrust bearings between spindle portions of different diameter, which thrust bearings may be provided within the roller, spaced from the ends of the spindle. Where the expansion member incorporates a sealed lubrication system, such as described above with reference to the first aspect of the invention, the thrust bearings may thus be located within the lubricated portion of the roller. In such embodiments, the provision of a larger diameter spindle allows for a larger volume of lubricant to be provided within the spindle, and with little or no adverse effect on spindle rigidity and robustness.

A member may be provided to retain the spindle relative to the carrier. Preferably, the retaining member extends through a portion of the spindle, and may be in the form of a pin or stopper.

According to a yet further aspect of the present invention there is provided a method of assembling an expansion member for a rotary expansion tool comprising a carrier, a spindle and a roller having a throughbore to receive the spindle, the method comprising the steps of:

axially translating the spindle into the roller; and then locating the roller on the carrier such that first and second ends of the spindle engage and are retained by the carrier.

Assembly of such an expansion member is likely to be easier than if it was necessary to locate the roller on the carrier before locating the spindle in the roller. Furthermore, when the member incorporates a sealed lubrication system, or indeed any bearing arrangement, the ability to assemble the spindle and roller before the roller is mounted on the carrier offers a number of advantages. For example, if an operator wishes to replace a roller or spindle in the field, a pre-assembled spindle/roller unit may be utilised. This unit may have been assembled in a clean, controlled environment, thus avoiding or minimising the risk of contamination or damage, which is far more likely to occur if the roller and spindle must be assembled on a carrier in the field.

In this and other aspects of the invention the carrier, spindle and roller may be supplied as a unit, ready to drop into a tool, to facilitate redressing of tools, with the replaced unit being returned to the supplier in assembled form for refurbishment or repair. The unit may be supplied "ready-to-use", and charged with lubricant.

Preferably, the method further comprises axially fixing the spindle relative to the carrier, such as by passing a pin or stopper through a portion of the spindle to engage the carrier.

Another aspect of the invention relates to a method of assembling an expansion member for a rotary expansion tool comprising a carrier including two aligned bores, a spindle and a roller having a throughbore to receive the spindle, the method comprising the steps of:

locating the roller relative to the carrier such that the roller is positioned between the carrier bores and the carrier bores and the roller throughbore are aligned; and then axially translating the spindle into the aligned bores and the throughbore.

Where appropriate, the various aspects of the present invention and the associated preferred features may of course be combined in a single tool or method. Also, for brevity, the various preferred alternative features of all of the various aspects of the invention have not been specifically listed, and those of skill in the art will recognise that many of the features described above are suitable for use in combination with more than one aspect of the invention.

Although described herein primarily with reference to expansion tools, features of the invention have utility in a range of other downhole tools, including cutting tools such as drill bits, reaming devices, milling devices and casing cutting devices, and other devices such as centralisers and stabilisers, and indeed any tool having rotatable parts.

As used herein, the term "sealed" as applied to the lubrication system is intended to encompass close tolerance limited leakage systems.

By virtue of the present invention there is provided an expansion member for a rotary expansion tool with a self-contained lubrication system providing a primary bearing surface which is lubricated and isolated from well materials.

BRIEF DESCRIPTION OF THE DRAWINGS

Embodiments of the present invention will now be described with reference to the accompanying drawings in which.

DETAILED DESCRIPTION

Figure 1:
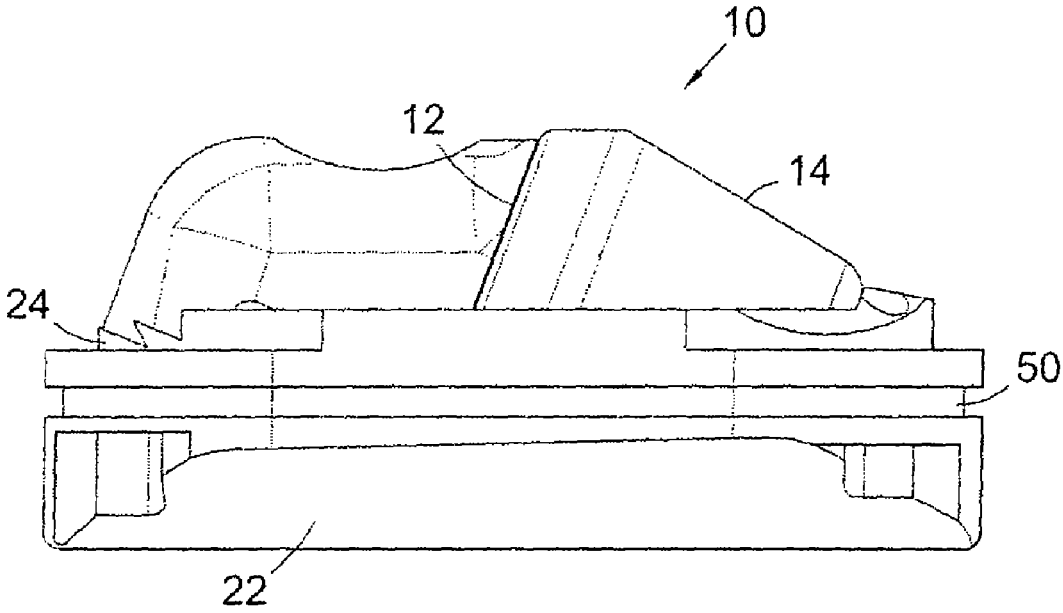
FIG. 1 is a side view of an expansion member according to a first embodiment of the present invention.
Figure 2:
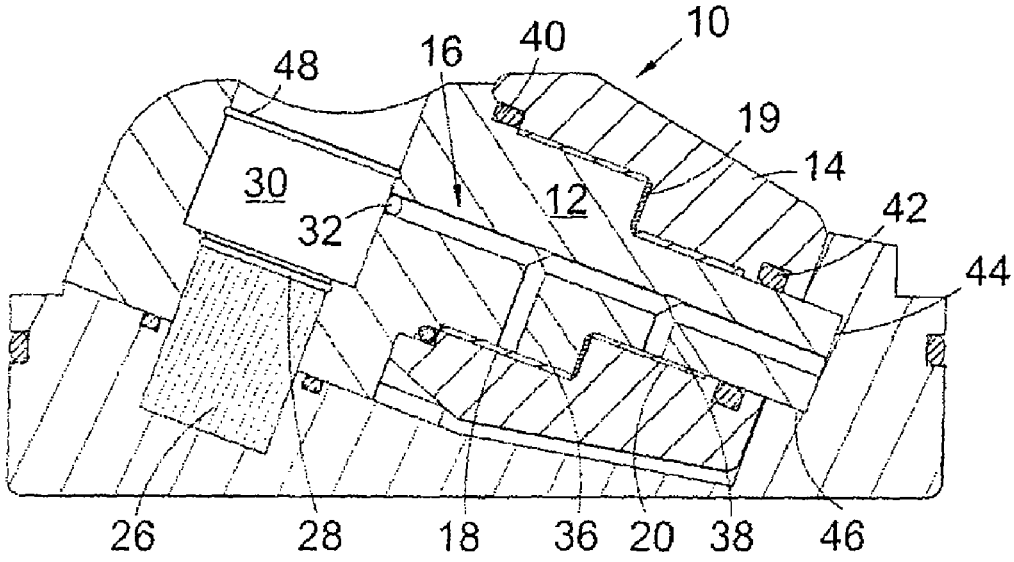
FIG. 2 is a cross-sectional side view of the expansion member of FIG. 1.

Referring firstly to FIGS. 1 and 2, a side view and a cross-sectional side view of an expansion member, generally indicated by reference numeral 10, according to a first embodiment of the present invention.

The expansion member 10 is adapted to be fitted to a downhole expansion tool (not shown), generally as one of a set of three expansion members 10 spaced at 120° intervals around the circumference of the tool.

The expansion member 10 includes a spindle 12 and a roller 14 mounted concentrically on the spindle 12. The spindle 12 is coupled to an expansion member carrier 22 by a dovetail groove connection 24 aligned with the spindle axis. To assemble expansion member 10, the spindle 12 is slid along the dovetail groove 24 into the roller 14 until the spindle end 44 engages a carrier recess 46, or more preferably the spindle 12 and roller 14 are assembled before the spindle 12 is made up to the carrier 22. The spindle 12 is then pinned in position using a stop pin 26 and a circlip 28 (FIG. 2). The dovetail groove connection 24 prevents radial and rotational movement of the spindle 12 with respect to the carrier 22, and the stop pin 26 prevents axial movement of the spindle 12 with respect to the carrier 22.

The provision of a roller 14 which is supported at both ends but which is mounted on a spindle 12 which does not have to extend through a bore in the carrier 22 offers numerous advantages, one being that, as in this embodiment, the spindle may include relatively large diameter portions without the requirement to provide a similarly large diameter bore in the carrier. Such large diameter portions also improve the strength and rigidity of the spindle, and allow for provision of a relatively large area bearing. Assembly and disassembly is also facilitated.

Referring now in particular to FIG. 2, contained within the spindle 12, and independent of the carrier 22, is a sealed lubrication system 16 for supplying lubricant to first and second radial bearings 18, 20 located at an interface between the spindle 12 and the roller 14, and also a thrust bearing 19 therebetween.

Lubricant is stored within a reservoir 30 and is fed through a one-way check valve 32 to a main supply channel 34 running axially through the spindle 12, although it will be noted the channel 34 is inclined to the spindle axis. From the main supply channel 34 lubricant is fed to the bearings 18,19,20 through radial first and second bearing supply channels 36,38.

Pressure equalisation is maintained between the lubricant and external fluid pressure via a circlip-retained diaphragm 48 which forms a wall of the reservoir 30.

Lubricant is prevented from leaking from the radial bearings 18,20 by first and second O-ring seals 40,42. The O-rings 40,42 also prevent the ingress of well fluids into the bearings 18,20. Due to the pressure equalisation feature described above, in use the seals 40,42 experience little if any differential pressure.

The carrier 22 is provided with a recess 50 to accommodate an O-ring seal to provide a sliding seal between the carrier and a tool body.

Figure 3:
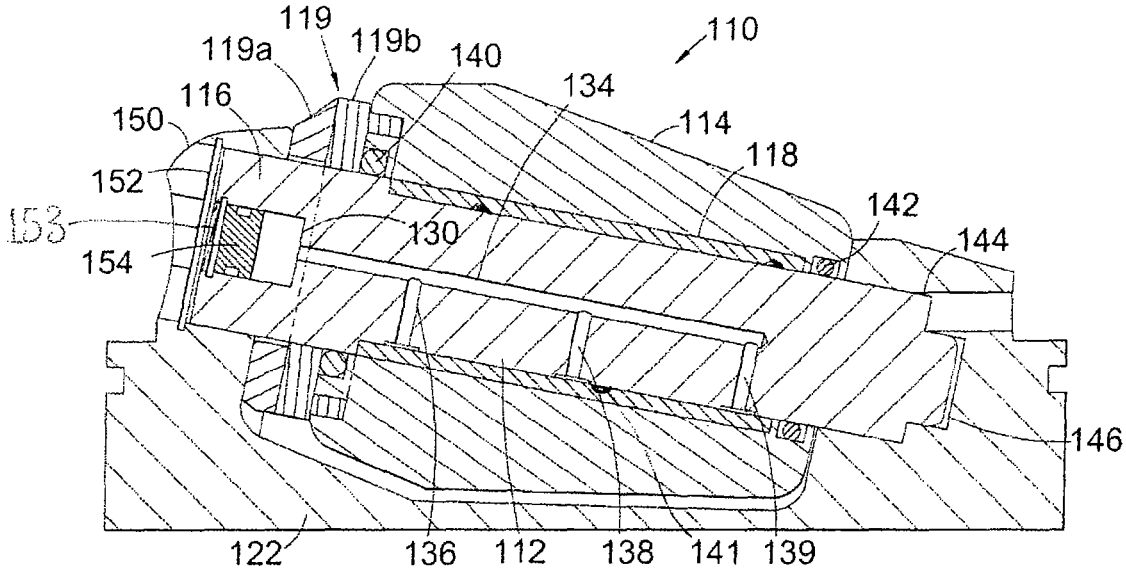
FIG. 3 is a cross-sectional side view of an alternative expansion member according to a second embodiment of the present invention.
Figure 4:
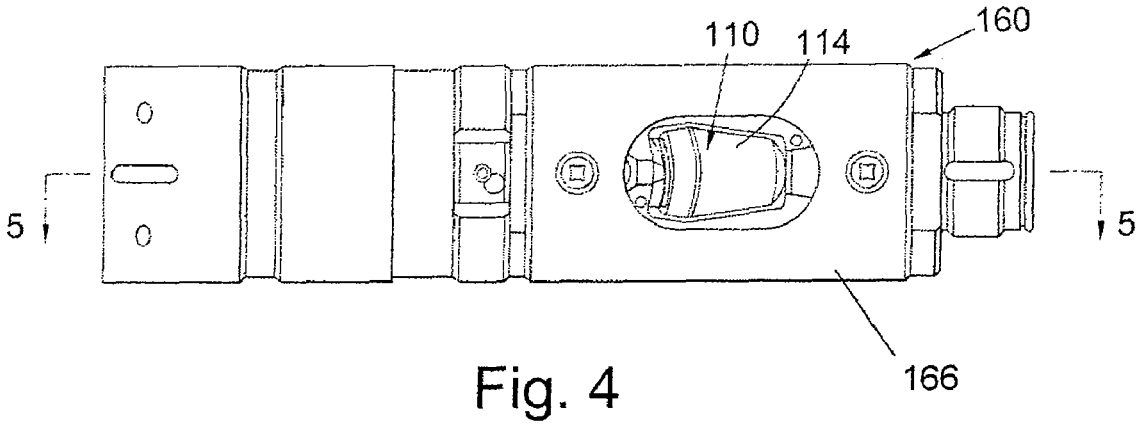
FIG. 4 is a plan view of an expansion tool comprising three expansion members as illustrated in FIG. 3.
Figure 5:
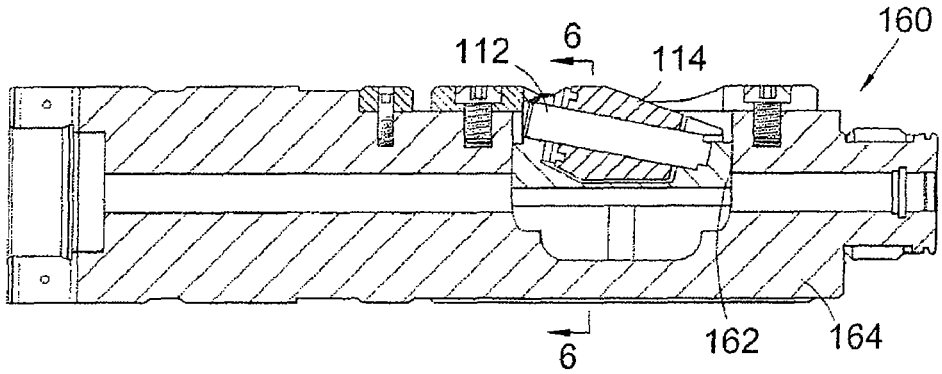
FIG. 5 is a sectional view on line 5-5 of FIG. 4.
Figure 6:
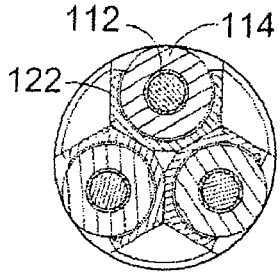
FIG. 6 is a sectional view on line 6-6 of FIG. 5.

Referring now to FIG. 3, there is shown a cross-sectional side view of an alternative expansion member 110 according to a second embodiment of the present invention, FIGS. 4, 5 and 6 showing the member 110 mounted in an expansion tool.

The expansion member and tool share many features with the tools described in applicant's US Patent Application Publication No. US 2005/0072569, which is herein incorporated by reference in its entirety.

The expansion member 110 comprises a spindle 112 and a roller 114 mounted concentrically on the spindle 112. The spindle 112 is supported at both ends and the roller is mounted between the supported ends. The expansion member 110 is assembled by passing the spindle 112 through a throughbore 150 defined by a carrier 122, and through the roller 114. The spindle end 144 engages a housing recess 146 defined by the carrier 122 and is secured in position by, for example, a circlip 152.

The expansion member 110 also includes a sealed lubrication system 116 contained within the spindle 112. The lubrication system 116 comprises a reservoir 130, a main supply channel 134 and three bearing supply channels 136,138,139. Lubricant is fed from the reservoir 130 via the channels 134, 136, 138, 139 to a radial bearing 118 located at the interface between the spindle 112 and the roller 114. The bearing 118 may feature a helical surface groove 141, which ensures that lubricant is distributed over the surface of the bearing. The lubrication system 116 is contained wholly within the spindle 112, independent of the carrier 122. Thus it is not required to provide lubrication channels between the carrier 122 and the spindle.

Pressure equilibrium is maintained between the system 116 and external or ambient pressure via a floating piston 154 which forms a wall of the reservoir 130. Furthermore, a compression spring 153 may be provided between the circlip 152 and the piston 154.

The system 116 is sealed by first and second O-ring seals 140, 142, which also protect the radial bearing 118 from the external fluids.

The expansion member 110 also features a two-part thrust bearing 119, arranged such that relative movement only occurs between the bearing parts 119*a*, 119*b*.

FIGS. 4, 5 and 6 illustrate the member 110 mounted in an expansion tool 160, together with two other members. The members 110 are located in laterally extending windows 162 in the tool body 164 and, in this embodiment, are radially restrained by a windowed sleeve 166 mounted over the body 164. The members 110 are illustrated in the retracted configuration, and it will be noted that the carriers 122 nest together, leaving a fluid flow path 168 through the carriers 112.

Various modifications may be made to the described embodiment without departing from the scope of the invention. For example, it will be understood any suitable type of bearing or bearing surface could be used such as roller bearings, needle roller bearings, journal bearings and the like. Where the roller axes are skewed, such that rotation of the expansion tool creates a tractor effect, heavier duty thrust bearings may be advised to support the additional thrust load between the rollers and the spindles, as the rollers push or pull the tool though the tubular. A thrust bearing may be provided at or on a leading end or nose of a roller, particularly with the skewed rollers which provide a tractor effect. This is to prevent wear in situations whereby the axial travel promoted by the roller skew angle is not matched by that of the tool itself, for example when the operator physically restrains axial movement of the tool, but still operates the tool in order to expand a tubular at one discrete location.

The above description makes reference primarily to tubing, and within the context of the various aspects of the invention this is intended to encompass any expandable tubular utilised in downhole operations, including casing, liner, sandscreen and patches, and the tools may be utilised to expand tubular in open or previously lined bores.

Those of skill in the art will recognise that the above described embodiments of the invention each provide an expansion member for a rotary expansion tool with a self-contained pressure-compensated lubrication system providing a primary bearing surface which is lubricated and isolated from well materials. Those of skill in the art will also recognise that the principles of the invention apply to close tolerance limited leakage lubrication systems.

The invention claimed is:

1. An expansion member for a rotary expansion tool, the expansion member comprising:

a carrier;

a spindle adapted to be supported at both ends in the carrier, wherein the spindle and carrier define corresponding profiles to provide for radial restraint of the spindle relative to the carrier;

a roller mounted concentrically on the spindle, wherein the carrier, the spindle and the roller are configured to be movable as a unit in the rotary expansion tool between a retracted position and an extended position;

a sealed lubrication system having a lubricant reservoir, wherein the sealed lubrication system is contained within the spindle for supplying lubricant to at least one of a portion of at least one bearing or a bearing surface located at an interface between the spindle and the roller; and a first seal member and a second seal member disposed on opposite sides of the at least one bearing or the bearing surface.

2. The expansion member of claim 1, wherein the at least one bearing is at least one radial bearing.

3. The expansion member of claim 1, wherein the at least one bearing is at least one of a journal bearing, roller bearing, thrust bearing, and a combination thereof.

4. The expansion member of claim 1, wherein the bearing is axially contained at both ends by faces formed by at least one of the spindle and the roller, which faces engage axial end faces of the bearing.

5. The expansion member of claim 4, wherein faces of at least one of the spindle and roller define a bearing contact area of substantially at least the same extent as the axial faces of the bearing.

6. The expansion member of claim 5, wherein the bearing contact area is provided by shoulders on one of the spindle and roller.

7. The expansion member of claim 1, wherein the lubrication system is arranged to urge lubricant towards at least one of said bearing and bearing surface.

8. The expansion member of claim 1, wherein the lubricant reservoir comprises a cylindrical volume defined within the spindle.

9. The expansion member of claim 1, wherein the lubricant reservoir has a variable volume.

10. The expansion member of claim 9, wherein a wall of the lubricant reservoir is biased to reduce the volume of the reservoir.

11. The expansion member of claim 10, wherein said wall comprises a spring-biased piston.

12. The expansion member of claim 1, wherein the lubrication system comprises at least one lubricant supply channel.

13. The expansion member of claim 12, wherein the at least one lubricant supply channel extends along the spindle axis.

14. The expansion member of claim 13, comprising a further lubricant channel providing fluid communication between an axial lubricant channel and the spindle\roller interface.

15. The expansion member of claim 14, wherein the further lubricant channel extends substantially radially from the axial lubricant channel.

16. The expansion member of claim 1, wherein bearing surfaces of at least one of the spindle, bearing and roller define surface channels to facilitate supply of lubricant to the surfaces.

17. The expansion member of claim 16, wherein the surface channel is a helical channel in a bearing surface.

18. The expansion member of claim 1, wherein the lubrication system permits communication of external pressure to the lubricant, allowing pressure equalisation to be maintained between the lubrication system and external pressure.

19. The expansion member of claim 1, wherein the carrier comprises a piston for mounting in a tool body.

20. The expansion member of claim 19, comprising a plurality of members and carriers, wherein the carriers are arranged to be radially movable relative to the body.

21. The expansion member of claim 20, wherein the rollers are compliant.

22. The expansion member of claim 1, wherein the seal members are O-rings.

23. The expansion member of claim 12, wherein the lubrication system comprises a check valve disposed between the lubricant reservoir and the least one lubricant supply channel.

24. The expansion member of claim 1, wherein the first seal member and the second seal member are configured to contain the lubricant within at least one bearing or the bearing surface.

25. A rotary expansion tool comprising:

a body;

at least one expansion member movable between a retracted configuration and an extended configuration, the expansion member comprising a spindle; a roller mounted on the spindle;

a sealed lubrication system having a lubricant reservoir, wherein the sealed lubrication system is contained within the spindle for supplying lubricant to a bearing surface located at an interface between the spindle and the roller and wherein the bearing surface includes a helical groove formed longitudinally and tangentially on the bearing surface; and a first seal member disposed on one side and a second seal member disposed on another side of the bearing surface.

26. An expansion member for a rotary expansion tool, the expansion member comprising:

a carrier adapted for mounting on an expansion tool body;

a spindle having a first end with a first shaped profile and a second end with a different second shaped profile, the spindle ends being retained and supported by the carrier, wherein the different second shaped profile on the second end of the spindle engages with a corresponding profile on the carrier to provide for radial restraint of the spindle relative to the carrier and wherein the different second shaped profile and the corresponding profile are dovetail profiles, and a roller mounted on the spindle.

27. The expansion member of claim 26, wherein at least one end of the spindle is keyed to a face of the carrier.

28. The expansion member of claim 26, wherein an outer or proximal end of the spindle is received by a corresponding recess or bore in the carrier to restrain the spindle against radial movement relative to the carrier.

29. A method of assembling an expansion member for a rotary expansion tool having a carrier, a spindle and a roller, the method comprising:

axially translating the spindle into a bore of the roller; and locating the roller on the carrier such that a first end of the spindle with a first shaped profile and a second end with a different second shaped profile engage and are retained by the carrier, wherein the second end of the spindle with the different second shaped profile and the carrier define corresponding dovetail profiles to provide for radial restraint of the spindle relative to the carrier.

* * * * *